US010239321B2

(12) United States Patent
Imamura et al.

(10) Patent No.: US 10,239,321 B2
(45) Date of Patent: Mar. 26, 2019

(54) LIQUID EJECTION HEAD AND METHOD FOR MANUFACTURING FLOW PASSAGE MEMBER OF LIQUID EJECTION HEAD

(71) Applicant: CANON KABUSHIKI KAISHA, Tokyo (JP)

(72) Inventors: Isao Imamura, Kawasaki (JP); Masashi Miyagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/362,650

(22) Filed: Nov. 28, 2016

(65) Prior Publication Data

US 2017/0157937 A1 Jun. 8, 2017

(30) Foreign Application Priority Data

Dec. 2, 2015 (JP) ..... 2015-235639
Nov. 8, 2016 (JP) ..... 2016-217981

(51) Int. Cl.

| | |
|---|---|
| ***B41J 2/175*** | (2006.01) |
| ***B41J 2/155*** | (2006.01) |
| ***B41J 2/16*** | (2006.01) |
| ***B41J 29/38*** | (2006.01) |

(52) U.S. Cl.

CPC ..... *B41J 2/175* (2013.01); *B41J 2/155* (2013.01); *B41J 2/16* (2013.01); *B41J 2/164* (2013.01); *B41J 2/1606* (2013.01); *B41J 2/17509* (2013.01); *B41J 29/38* (2013.01); *B41J 2202/20* (2013.01)

(58) Field of Classification Search

CPC ..... B41J 2/175; B41J 2002/14306; B41J 2/14145; B41J 2202/03; B29K 2503/00

See application file for complete search history.

(56) References Cited

U.S. PATENT DOCUMENTS

2011/0279547 A1* 11/2011 Hattori ..... B41J 2/1623 347/54
2012/0033017 A1 2/2012 Iwanaga
2014/0132672 A1* 5/2014 Goto ..... B41J 2/1603 347/44

FOREIGN PATENT DOCUMENTS

| | | | |
|---|---|---|---|
| CN | 101549583 | A | 10/2009 |
| CN | 102036823 | A | 4/2011 |
| CN | 103818119 | A | 5/2014 |
| JP | H07-068794 | A | 3/1995 |
| JP | 2002-052712 | A | 2/2002 |
| JP | 2010-247508 | A | 11/2010 |
| JP | 2015-020285 | A | 2/2015 |

* cited by examiner

*Primary Examiner* — Henok Legesse
(74) *Attorney, Agent, or Firm* — Canon U.S.A. Inc., IP Division

(57) ABSTRACT

A liquid ejection head for ejecting a liquid, including a flow passage member, which is composed of a first resin and which is provided with a flow passage configured to come into contact with the liquid, and a plurality of resin-coated members having a core-sheath structure composed of a filler constituting an inner core and a second resin constituting an outer core, wherein the plurality of the resin-coated members are contained in the flow passage member.

13 Claims, 6 Drawing Sheets

LIQUID EJECTION HEAD AND METHOD FOR MANUFACTURING FLOW PASSAGE MEMBER OF LIQUID EJECTION HEAD

BACKGROUND OF THE INVENTION

Field of the Invention

The present disclosure relates to a liquid ejection head and a method for manufacturing a flow passage member of the liquid ejection head. In particular, the present disclosure relates to technology for forming a flow passage member by adding a filler to a structural material, e.g., resin.

Description of the Related Art

An inkjet recording head (hereafter also simply referred to as a recording head), in which a support member for supporting a substrate provided with an energy-generating element is formed by filling a resin with a filler, is known as an example of a liquid ejection head. Japanese Patent Laid-Open No. 2010-247508 discloses that in a recording head, a support member for supporting a substrate is formed by filling a resin with a filler. In forming the support member, the use of a filler reduces the linear expansion coefficient and, thereby, the stress generated between the support member and the substrate to be bonded is reduced.

The support member described in Japanese Patent Laid-Open No. 2010-247508 is formed to be provided with a flow passage for the purpose of ensuring ink communication between an ink supply chamber and the substrate and is produced inexpensively compared with alumina, which is commonly used as a material for forming the support member.

However, in the case of the above-described support member, in which the flow passage member provided with a flow passage disposed to come into contact with a liquid, e.g., ink, is formed by filling a formed material, e.g., a resin, with a filler, the filler particles are exposed at the surface of the formed material and may be dissolved into the liquid, e.g., the ink. In particular, in the case where a relatively large amount of filler is added so as to realize a small linear expansion coefficient, the filler is exposed at the surface and is easily dissolved into the liquid. The filler dissolved into the liquid, as described above, may exert harmful effects, e.g., clogging of a recording head nozzle.

SUMMARY OF THE INVENTION

The present disclosure provides a liquid ejection head for ejecting a liquid, including a flow passage member composed of a first resin and provided with a flow passage configured to come into contact with the liquid and a plurality of resin-coated members each having a core-sheath structure composed of a filler constituting an inner core and a second resin constituting an outer core, wherein the plurality of the resin-coated members are contained in the flow passage member.

Further features of the present disclosure will become apparent from the following description of exemplary embodiments with reference to the attached drawings.

DESCRIPTION OF THE EMBODIMENTS

The example embodiments according to the present disclosure will be described below in detail with reference to the drawings.

Figure 1A:
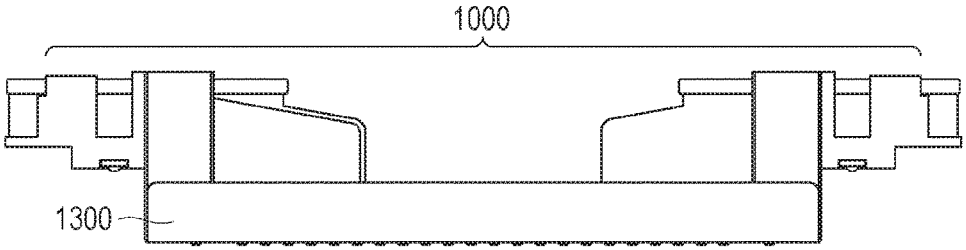
FIGS. 1A and 1B are a side view and a plan view, respectively, of an inkjet recording head according to an example embodiment of a liquid ejection head.
Figure 1B:
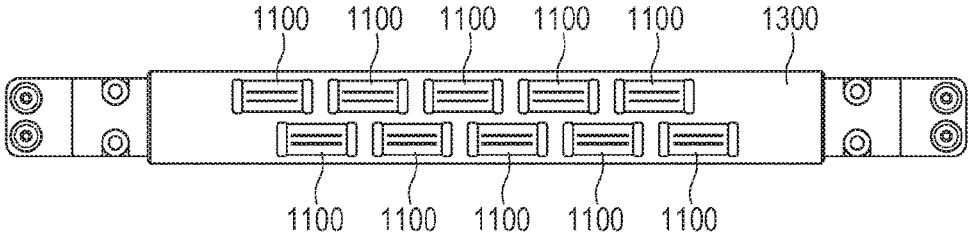
Figure 2:
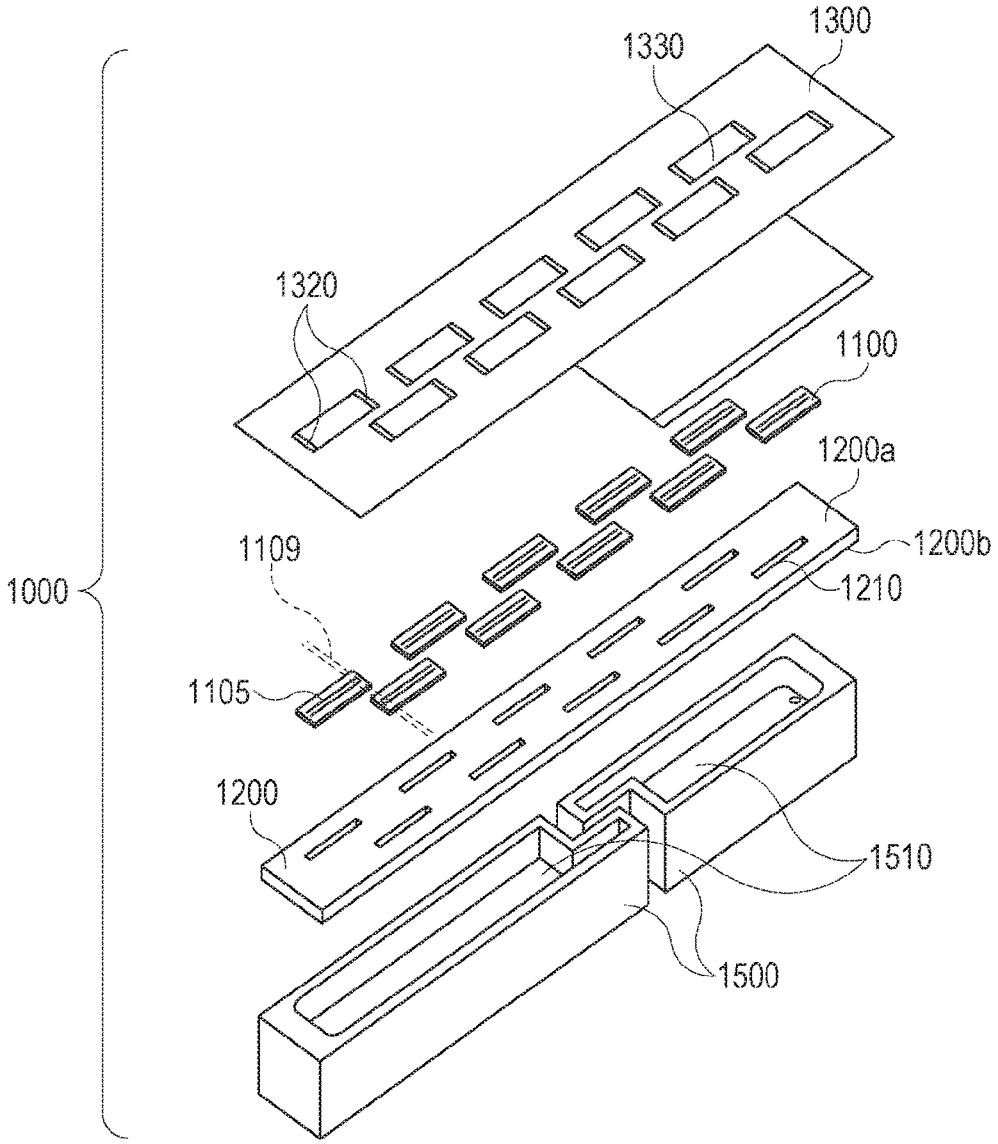
FIG. 2 is an exploded perspective view of the recording head shown in FIGS. 1A and 1B.

FIGS. 1A and 1B are a side view and a plan view, respectively, of an inkjet recording head according to an embodiment of a liquid ejection head of the present invention. FIG. 2 is an exploded perspective view of the recording head shown in FIGS. 1A and 1B.

As shown in FIGS. 1A and 1B, an example embodiment of a recording head 1000 is provided with a plurality of recording element boards 1100 in a staggered array, and an ink is ejected from nozzles constituting a recording element disposed in each recording element board. In the recording head 1000, an electric wiring board 1300 is disposed around each recording element board 1100 and, thereby, transmission and reception of electric signals and the like are performed between each recording element board 1100 and a recording apparatus main unit, on which the recording head 1000 is mounted. The recording head 1000 according to the present embodiment is a full-line type recording head. That is, all nozzles of the plurality of recording element boards 1100 are arrayed in a range corresponding to the width of a recording medium being conveyed.

As shown in FIG. 2, the recording head 1000 according to the present embodiment is configured to include the recording element board 1100 composed of silicon (Si), a base plate 1200 for supporting the recording element board, the electric wiring board 1300 for electrically connecting the recording element board to the recording apparatus, and ink supply members 1500 bonded to the base plate 1200. The plurality of recording element boards 1100 are staggered in a direction intersecting the conveyance direction of the recording medium on the principal surface 1200*a* of the base plate 1200. The ink supply members 1500 are bonded to the surface 1200*b* on the side opposite to the principal surface 1200*a*. In this configuration, the ink stored in ink reservoirs 1510 disposed in the ink supply members 1500 is supplied, on a nozzle basis, to pressure chambers each provided with a heat-generation heater in the recording element boards 1100 through ink supply slits 1210 disposed in the base plate 1200 and in accordance with each of the recording elements.

As described above, flow passages (slits 1210) of the ink are disposed in the base plate 1200. The base plate 1200 is formed of a resin that contains a filler, as described later in detail.

The material for forming the base plate 1200 serving as the flow passage member and the forming method will be described below. The base plate according to the present embodiment of the present invention is produced by coating a filler, which is mixed into a forming resin, with a resin different from the forming resin, as described later with reference to FIG. 3 and the like. Consequently, exposure of the filler particles at the surface of the base plate is prevented.

To begin with, the filler that is mixed into the forming resin will be described as a constituent material. Examples of fillers used in the present embodiment include silica, fused silica, calcium carbonate, hydrated alumina, zircon cordierite, mica, talc, magnesium hydroxide, and glass fiber. There is no particular limitation regarding the shape of the filler particles according to the present invention. In order to increase the filling factor, a spherical particle shape can be employed, and in order to realize the tightest packing, it is desirable that fillers having different particle diameters be mixed into the resin. The ratio of large-diameter particles to small-diameter particles preferably ranges from about 9:1 to 6:4.

In particular, fused silica has a small linear expansion coefficient and is inexpensive. In addition, the particle shape is spherical and, therefore, particles having various particle diameters may be mixed to realize the tightest packing. The glass fibers are in the shape of fibers and, therefore, in the case where a coating film is disposed by, for example, a method including dipping into a coating solution described later and performing extraction before a cut fiber step by using a pulverizer, agglomeration of fibers is prevented and the coating film thickness is easily controlled.

A plurality of types of fillers may be used in combination in accordance with required characteristics. For example, in the case of a container or the like for a strong alkaline solution, good resistance may be obtained by using alumina, which has high chemical resistance.

There is no particular limitation regarding the resin with which the filler is coated. In the case where the resin is a thermoplastic material, the melting point can be sufficiently higher than the temperature of kneading with the filler and the temperature of the resin at the time of forming, as described later. The melting point of the resin with which the filler is coated can be higher than the melting point of the resin for forming the flow passage member. Consequently, melting of the coating resin of the filler is suppressed in the state of heating during forming of the base plate and, thereby, exposure of the filler due to melting of the resin-coated member is suppressed. Examples thereof include HIMAL, which is a polyetheramide resin, produced by Hitachi Chemical Company, Ltd. HIMAL has a high glass transition temperature and exhibits good chemical resistance. Meanwhile, in the case where the resin is a thermosetting resin, examples thereof include phenol resins, urea resins, melamine resins, and unsaturated polyester resins. Most of all, epoxy resins are suitable from the viewpoints of adhesion to the filler, resistance to the ink, and the like. Here, the epoxy resin refers to an epoxy resin composition composed of an epoxy resin, a curing agent, a curing accelerator, a silane coupling agent, and the like. Either a solid or a liquid is employed because a solution is prepared when the filler is coated.

Among the epoxy resin compositions, examples of epoxy resins include bisphenol A epoxies, glycidyl ether type or glycidyl amine type epoxies, e.g., glycidyl ethers of bisphenol F, bisphenol AD, or compounds to which an alkylene oxide is further added, epoxy novolac resins, bisphenol A novolac diglycidyl ethers, and bisphenol F novolac diglycidyl ethers, and alicyclic epoxies. In addition, not only liquid resins but also solid resins may be used as long as a liquid resin composition is prepared. Examples of solid resins include epoxies having a biphenyl skeleton, a naphthalene skeleton, a cresol novolac skeleton, a trisphenolmethane skeleton, a dicyclopentadiene skeleton, a phenol-biphenylene skeleton, or the like.

In the epoxy resin composition, there is no particular limitation regarding the curing agent. For example, amines, tertiary amines, polyamides, acid anhydrides, imidazoles, and phenols may be used. Further, materials, in which epoxy resins are added to such curing agents so as to improve the pot life and the reactivity, may be used. Examples of acid anhydrides as curing agents include tetrahydrophthalic anhydride, methyltetrahydrophthalic anhydride, hexahydrophthalic anhydride, methylhexahydrophthalic anhydride, methylnadic anhydride, hydrogenated methylnadic anhydride, and trialkyltetrahydrophthalic anhydride. Examples of imidazoles include 2-ethyl-4-methylimidazole and 1-(2-cyanoethyl)-2-ethyl-4-methylimidazole. Examples of solid curing agents include phenol curing agents, e.g., xylylene novolac, biphenyl novolac, and dicyclopentadiene phenol novolac.

A flexibility-imparting agent or other additives may be added to the resin composition by employing a commonly used method. Examples of flexibility-imparting agents include common alcohol-modified epoxies, e.g., 1,6-hexane diol diglycidyl ether and glycerin triglycidyl ether, urethane-modified epoxies, and silicone-modified epoxies. Also included are, for example, 1,1,3,3-tetramethyl-1,3-diglycidyl ether disiloxane and the like having a siloxane bond in a main chain.

A silane coupling agent may be added to the epoxy resin composition. Examples of silane coupling agents include γ-glycidoxypropyltrimethoxysilane, β-(3,4-epoxycyclohexyl)-ethyltrimethoxysilane, γ-mercaptopropyltriethoxysilane, and γ-aminopropyltrimethoxysilane. Titanate-based or aluminate based materials may also be used.

There is no particular limitation regarding the coating thickness when the filler is coated with the resin composition. However, in the case where the thickness is excessively large, the effect of adding the filler is decreased because the linear expansion coefficient is reduced, and the amount of filling of the forming resin is also reduced. There is a concern that filler particles may agglomerate easily because of the coating and not all of the filler particles may be coated. From the above-described points, the coating thickness is 0.1 μm or less and preferably 0.05 μm or less, although the coating thickness depends on the size of the filler.

Examples of forming resins kneaded with the filler include PPS, modified PPE, and LCP. These may be used in combination. For example, a mixture of relatively inexpensive PPS and modified PPE may be used. In this case, PPS is a material having high heat resistance and high fluidity, and modified PPE has excellent adherence, coating film properties, and mechanical characteristics. Consequently, in the case where a large amount of filler is added, as in the present embodiment, the fluidity of the forming material itself is reduced to a great extent. Therefore, the fluidity can be ensured by increasing the proportion of PPS, and modified PPE can be used in combination so as to maintain adhesion to the filler.

The amount of the coated filler added is changed depending on the type, shape, and melting viscosity of the forming resin. In the case where the filler is added such that the mass content becomes 60% or more relative to the forming resin, the proportion of the filler exposed at the forming surface increases and the effects of the present invention are effectively exerted. For example, in the case where fused silica is used for the filler, the effects of the present invention are effectively exerted when the filler is added in an amount of 75 percent by weight or more.

Next, a method for forming the base plate 1200 will be described.

Figure 3:
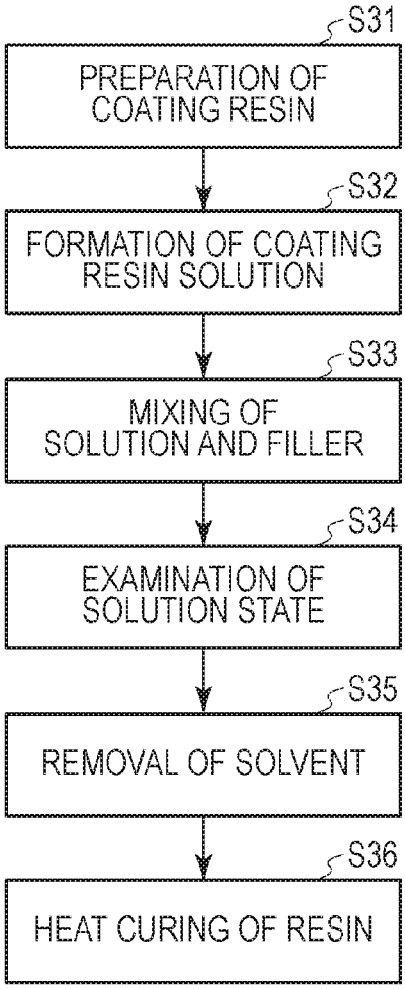
FIG. 3 is a flow chart showing the treatments for forming a base plate, according to an example embodiment.

FIG. 3 is a flow chart showing the treatments for forming the base plate composed of the above-described material.

In Step S31, the coating resin is prepared. Table 1 shows two epoxy resin compositions serving as the coating resin. In Table 1, the composition indicated by the number "1" is a liquid, and the composition indicated by the number "2" is a solid. In the explanations below, the exemplary embodiments (hereafter referred to as Exemplary embodiment 1 and Exemplary embodiment 2) in which coated materials of the fillers are formed by using Epoxy resin compositions 1 and 2, respectively, will be described. However, the treatments for forming the two are the same unless otherwise specified and, therefore, Exemplary embodiment 1 and Exemplary embodiment 2 will not be differentiated in the explanations. Epoxy resin compositions 1 and 2 contain the silane coupling agent, although the silane coupling agent is not always necessary as long as the filler itself is subjected to a silane treatment. However, in the case where the silane coupling agent is also contained in the composition, the effect is exerted favorably from the viewpoint of improving the adhesion to the filler.

Table 1

TABLE 1

| Epoxy resin composition | | | | |
|---|---|---|---|---|
| | Product name | Manufacturer | 1 | 2 |
| Main agent | 828EL | MITSUBISHI CHEMICAL CORPORATION | 95 | |
| | HP-4710 | DIC | | 95 |
| Curing agent | jERCURE EMI24 | MITSUBISHI CHEMICAL CORPORATION | 4 | 2 |
| Silane coupling agent | A-187 | Momentive Performance Materials Inc. | 5 | 5 |
| Property | | | viscous liquid | solid |

In Step S32, a solution of the coating resin is formed (prepared). Specifically, the solution is prepared by mixing the above-described epoxy resin composition with MEK in a weight ratio of 1:1. The type of the solvent and the proportion of the solvent are not limited to this example. However, it is necessary that a solution state be produced when the epoxy resin composition is kneaded with the filler. This is because if the solution state is not produced, the entirety of the filler is not reliably coated with the resin solution and defects, e.g., pin holes, may be generated in the filler surface.

In Step S33, the solution formed in Step S32 and the filler are mixed. The filler is spherical fused silica. HS-304, produced by Micron Co., from which small-diameter particles have been cut so as to have an average particle diameter of 25 μm, is used. The particle diameter is not limited to this, and a few types of particles having different diameters may be combined for the sake of the tightest packing. The product, from which small-diameter particles have been cut, is used because if the proportion of small-diameter particles is large, the small-diameter particles agglomerate with a coating resin interposed therebetween and the coating resin does not spread throughout the filler.

In the present step, initially, the filler is subjected to a silane treatment. That is, 10 Kg of filler is placed into a Henschel mixer. Subsequently, a solution composed of 7 g of A-187 and 500 g of ethanol is placed into the mixer while agitation is performed at 700 rpm, and agitation is performed for 5 minutes. It is checked that the viscous solution is homogeneous, and steam is introduced. After the solvent is evaporated by the steam, the number of revolutions of agitation is set to be 1,400 rpm, and the state is maintained at 100° C. for 5 minutes. Then, cooling is performed.

The filler is coated with the coating resin. That is, 800 g of solution of Epoxy resin composition 1 or Epoxy resin composition 2, which is a solution in an amount corresponding to the coating thickness of 0.05 μm on the basis of a calculation based on the specific surface area of the filler, is placed into a Henschel mixer after cooling while agitation is performed at a low speed of about 50 rpm. Then, agitation is performed for 5 minutes.

In Step S34, it is checked that the viscous solution is homogeneous. Agitation is performed at 1,000 rpm for 10 minutes such that Epoxy resin composition 1 or Epoxy resin composition 2 spreads around each particle of the filler. The resin composition spreads throughout the filler regardless of being a viscous liquid or a solid by using the solution of the thermosetting resin, as described above.

In Step S35, the rotational speed is reduced to 700 rpm, steam is introduced (heating is performed) so as to evaporate the solvent. The solvent is heat-removed while agitation is performed, as described above, and thereby, each particle of the filler is uniformly coated with the resin.

In Step S36, heating and agitation are continued at 150° C. for 60 minutes so as to cure the resin-coated member and, thereafter, cooling is performed. Heating is performed under agitation and, thereby, the resin-coated member is cured without bonding of filler particles to each other. The filler coated with Epoxy resin composition 2 is subjected to additional heating in an oven at 200° C. for 1 hour so as to increase the degree of crosslinking. Curing of Epoxy resin composition 2 is promoted to a great extent by heating in a Henschel mixer. Therefore, filler particles do not adhere to each other even when additional heating is performed. The coated material of the filler, in which each of spherical particles of the filler is coated with the coating resin, is formed. Each particle of the coated material of the filler has a core-sheath structure, in which the outer core is the coating resin and the inner core is the filler, and the external shape of the coated material of the filler is substantially spherical.

Next, a treatment of mixing the coated material of the filler obtained by coating the filler with the resin, as described above with reference to FIG. 3, into the resin for forming the base plate will be described below.

A resin different from the above-described coating resin of the filler is used as the forming resin for preparing the base plate. Specifically, B-060P (produced by Tosoh Susteel) was used as PPS and XYRON SX101 (Asahi Kasei Chemicals Corp.) was used as modified PPE. A forming resin was prepared by pulverizing and mixing PPS and modified PPE in a ratio of 4:1.

As described above, the coated filler was HS-304 coated with Epoxy resin composition 1 in Exemplary embodiment 1 or HS-304 coated with Epoxy resin composition 2 in Exemplary embodiment 2. In this regard, in Comparative example 1, HS-304, which was used as the filler, was used with no coating. Likewise, in Comparative example 2, HS-304, which was used as the filler, was used with no coating.

Each of these fillers and the above-described forming resin in a weight ratio of forming resin:filler of 20:80 were kneaded and pelletized with a single-screw extruder so as to obtain a formed material in the shape of the base plate.

The evaluation results of the four thus prepared formed materials, that is, Exemplary embodiments 1 and 2 and Comparative examples 1 and 2, were as described below.

Figure 4A:
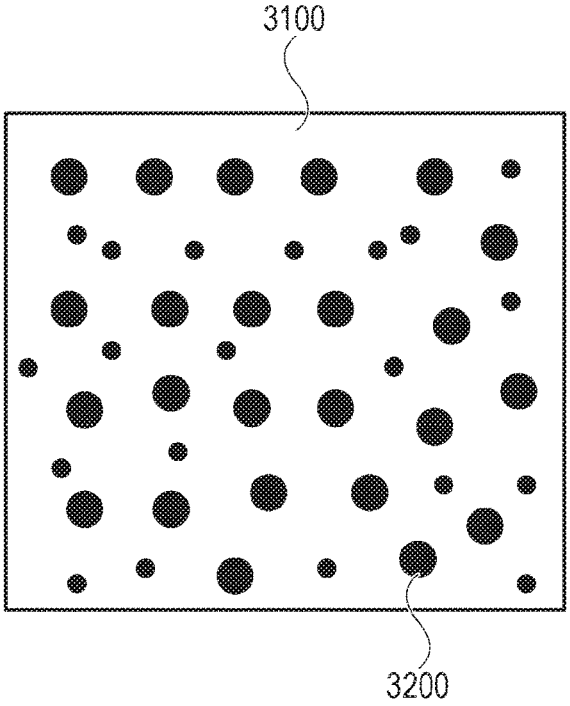
FIGS. 4A and 4B are diagrams showing the surface and the cross-section, respectively, of the formed material according to an example embodiment.
Figure 4B:
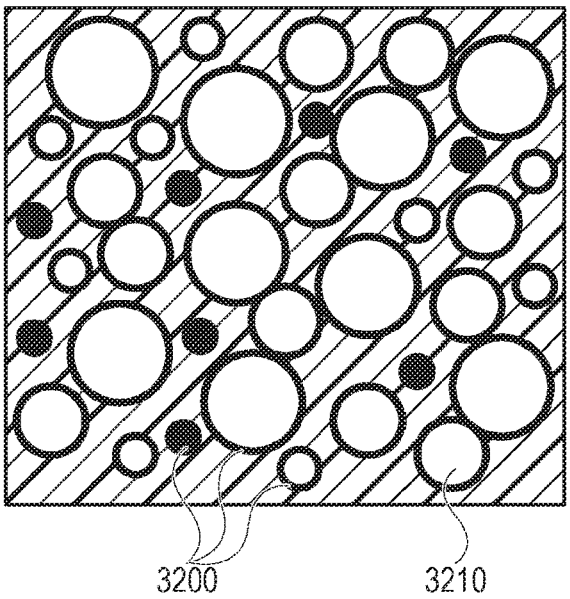
Figure 5A:
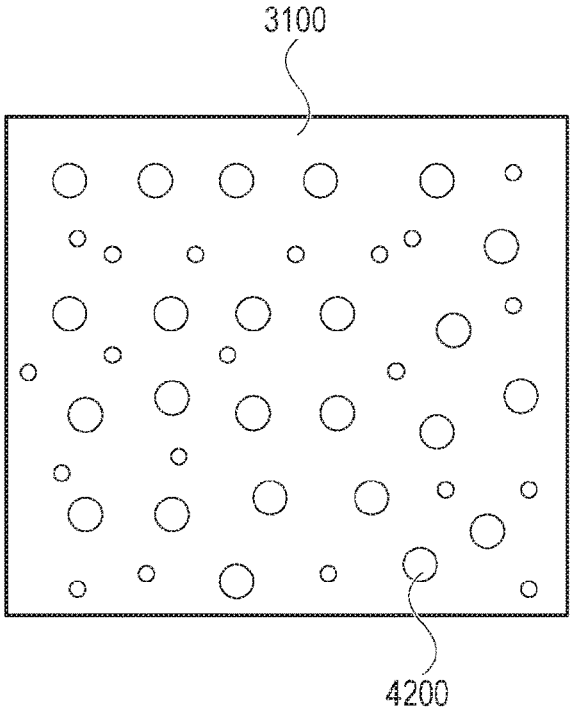
FIGS. 5A and 5B are diagrams showing the surface and the cross-section, respectively, of the formed material according to a comparative example.
Figure 5B:
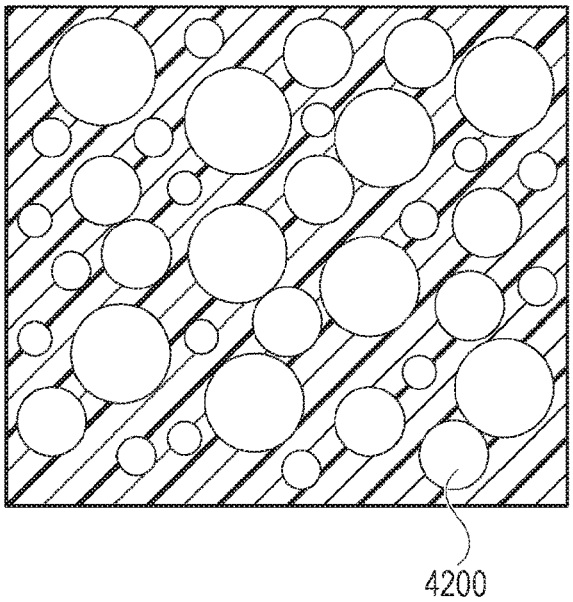

FIGS. 4A and 4B are diagrams showing the surface and the cross-section, respectively, of the formed material according to Exemplary embodiment 1 or Exemplary embodiment 2. FIGS. 5A and 5B are diagrams showing the surface and the cross-section, respectively, of the formed material according to Comparative example 1 or Comparative example 2.

All four formed materials have relatively high filler contents and, therefore, the fillers may be exposed at the surfaces of the formed materials. Regarding the formed material according to Exemplary embodiment 1 or Exemplary embodiment 2, as shown in FIG. 4A, the filler is exposed as particles, which are coated with the coating resin, of the resin-coated filler 3200. In particular, particles of the resin-coated filler 3200 are mixed into the forming resin 3100, and some of the particles are exposed at the surface of the formed material, where each particle of the filler is in a state of being entirely coated with the resin. That is, as shown in FIG. 4B, when each particle of the resin-coated filler 3200 of the formed material in Exemplary embodiment 1 or Exemplary embodiment 2 is cut, the particle of the filler 3210 indicated by white in FIG. 4B is in the state of being coated with the resin indicated by black.

On the other hand, regarding the formed material according to Comparative example 1 or Comparative example 2, as shown in FIG. 5A, when the filler is exposed at the surface of the formed material, particles which are not coated with the resin, of the filler 4200 itself are exposed. As is clear from the sectional view shown in FIG. 5B, the particle of the filler 4200 indicated by white in FIG. 5B is mixed in the formed material while not being coated.

As described above, in each of Exemplary embodiments 1 and 2 according to the embodiments of the present invention, even in the case where the filler is exposed at the surface of the formed material, the filler is coated with the resin. Consequently, when the formed material is a base plate (flow passage member) as in the case of the present embodiment, elution of the filler into the liquid, e.g., an ink, is prevented.

In a specific evaluation test, 10 g of the formed material produced by the above-described manufacturing method was dipped in 200 g of black ink at 60° C. for 1 month and, thereafter, the amount of elution of the filler into the ink was measured. As a result, in Exemplary embodiments 1 and 2, the amounts were 1 ppm or less and, therefore, elution was hardly recognized. On the other hand, in Comparative examples 1 and 2, about 10 ppm of elution of the filler was observed.

Configuration of Apparatus

Figure 6:
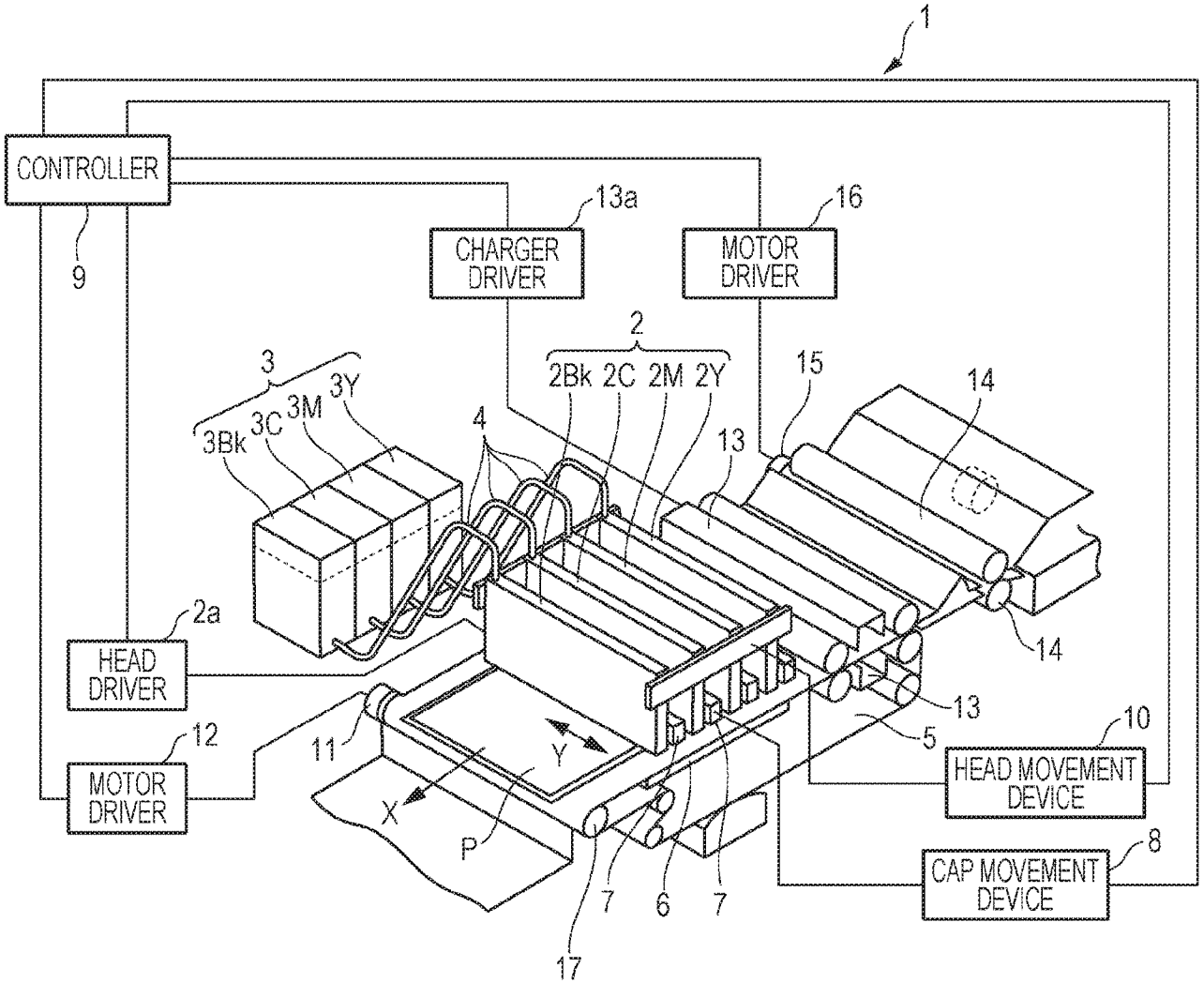
FIG. 6 is a perspective view of an inkjet recording apparatus provided with a recording head according to an example embodiment.

FIG. 6 is a perspective view of an inkjet recording apparatus according to an embodiment of the liquid ejection apparatus of the present invention. Inkjet recording apparatus 1 is a full-line type printer in which recording heads 2Y, 2M, 2C, and 2Bk extending in the direction (Y-direction: first direction) intersecting the conveyance direction of a recording medium P (X-direction: second direction) are disposed side by side, as shown in FIG. 6. Here, 2Y denotes a recording head for ejecting a yellow ink, 2M denotes a recording head for ejecting a magenta ink, 2C denotes a recording head for ejecting a cyan ink, and 2Bk denotes a recording head for ejecting a black ink. These recording heads are provided with the base plates produced in the manufacturing process described in the above-described embodiment. A recording head 2 is connected to four ink tanks 3Y, 3M, 3C, and 3Bk (hereafter these are collectively referred to as ink tank 3) storing a yellow ink, a magenta ink, a cyan ink, and a black ink, respectively, with respective connection pipes 4 interposed therebetween. Further, each tank of the ink tank 3 is exchangeable with respect to the connection pipe 4.

A controller 9 controls all mechanisms shown in FIG. 6 in order to control the operation of the entire inkjet recording apparatus 1. When the recording operation is performed, the controller 9 drives a feeding motor 15 by using a motor driver 16 so as to rotate a pair of feeding rollers 14. In accordance with the rotation, the recording medium P is fed in the X-direction shown in FIG. 6. The controller 9 drives a motor driver 12 so as to rotate a belt driving motor 11. In accordance with the rotation, a driving roller 17 coupled to the belt driving motor 11 is rotated, and a conveyance belt 5 looped over the driving roller 17 is moved. Further, the controller 9 drives a charger driver 13*a* and, thereby, actuates a charger 13 disposed upstream of the conveyance belt 5 so as to charge the recording medium P fed to the charger 13. The charged recording medium P is adsorbed onto the conveyance belt 5 and is conveyed in the X direction at a predetermined speed in association with the movement of the conveyance belt 5.

At the recording position on the conveyance route, a platen 6 for supporting the recording medium P from below and the recording head 2 for performing recording onto the recording medium P at this position are disposed. Each nozzle of the recording head 2 is electrically connected to the controller 9 with a head driver 2*a* interposed therebetween and ejects the ink in accordance with a drive signal transmitted from the controller 9. Consequently, dots are recorded onto the recording medium P that moves relative to the recording head. An image is recorded onto the recording medium P at a predetermined resolution by the controller 9 appropriately controlling the relationship between the conveyance speed of the recording medium P and the frequency of ejection of the ink from each nozzle of the recording head 2.

When a recovery process of the recording head 2 is executed, the controller 9 drives the head movement device 10 so as to temporarily raise the recording head 2 in the direction of decreasing proximity to the platen 6. Thereafter, a cap movement device 8 is moved so as to move a cap 7 to just below the recording head 2. Further, a head movement device 10 is driven so as to lower the recording head 2 toward the cap 7. The cap 7 comes into the state of covering an ejection port surface of the recording head 2 so as to receive waste ink discharged from the ejection port and forcedly suction the ink from the ejection port.

Other Embodiments

The recording head according to the above-described embodiment is of full-line type but is not limited to this form. For example, the present invention may be applied to, for example, a support member of a so-called serial type recording head.

As a matter of course, the member, to which the present invention is applied, is not limited to the above-described support member. Any member becomes the subject as long as the member comes into contact with the liquid, e.g., ink (referred to as "a flow passage member" in the present specification). For example, the flow passage member may be disposed in the liquid reservoir for storing the liquid or at least part of the liquid communication path enabling communication between the liquid reservoir and the liquid ejection head.

According to the above-described configuration, it is possible to provide a liquid ejection head in which the filler particles are not exposed at the surface of the flow passage member of the liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-217981 filed Nov. 8, 2016 and No. 2015-235639 filed Dec. 2, 2015, which are hereby incorporated by reference herein in their entirety.

What is claimed is:

1. A liquid ejection head for ejecting a liquid, comprising:

a flow passage member, which is composed of a first resin and which is provided with a flow passage configured to come into contact with the liquid;

a liquid supply member bonded to the flow passage member; and a plurality of resin-coated members having a core-sheath structure composed of a filler constituting an inner core and a second resin constituting an outer core, wherein the flow passage member comprises the plurality of the resin-coated members.

2. The liquid ejection head according to claim 1, wherein the melting point of the second resin is higher than the melting point of the first resin.

3. The liquid ejection head according to claim 1, wherein the second resin is heat-curable.

4. The liquid ejection head according to claim 1, wherein the second resin is an epoxy resin composition.

5. The liquid ejection head according to claim 1, wherein the mass content of the filler in the flow passage member is 60% or more.

6. The liquid ejection head according to claim 1, wherein the filler is fused silica.

7. The liquid ejection head according to claim 1, wherein the shape of the resin-coated member is spherical.

8. The liquid ejection head according to claim 1, wherein the flow passage member comprises:

a first surface for supporting a recording element board; and a second surface opposite to the first surface, and wherein the liquid supply member is bonded to the second surface.

9. The liquid ejection head according to claim 1, wherein the liquid supply member comprises a liquid reservoir, and wherein the flow passage member comprises a plurality of supply slits aligned with the liquid reservoir.

10. A liquid ejection apparatus provided with a liquid ejection head for ejecting a liquid, comprising:

a flow passage member, which is composed of a first resin and which is provided with a flow passage configured to supply the liquid;

a liquid supply member bonded to the flow passage member; and a plurality of resin-coated members having a core-sheath structure composed of a filler constituting an inner core and a second resin constituting an outer core, wherein the flow passage member comprises the plurality of the resin-coated members.

11. The liquid ejection apparatus according to claim 10, wherein the flow passage member is disposed in the path enabling communication between a liquid reservoir of the liquid supply member for storing the liquid and the liquid ejection head.

12. The liquid ejection apparatus according to claim 10, wherein the flow passage member comprises:

a first surface for supporting a recording element board; and a second surface opposite to the first surface, and wherein the liquid supply member is bonded to the second surface.

13. The liquid ejection apparatus according to claim 10, wherein the liquid supply member comprises a liquid reservoir, and wherein the flow passage member comprises a plurality of supply slits aligned with the liquid reservoir.

* * * * *